United States Patent [19]

Yasumura

[11] 4,308,495

[45] Dec. 29, 1981

[54] TRANSFORMER FOR VOLTAGE REGULATORS

[75] Inventor: Masayuki Yasumura, Kanagawa, Japan

[73] Assignee: Sony Corporation, Tokyo, Japan

[21] Appl. No.: 140,788

[22] Filed: Apr. 16, 1980

[30] Foreign Application Priority Data

Apr. 20, 1979 [JP] Japan ..... 54-49292

[51] Int. Cl.[3] ..... G05F 1/32

[52] U.S. Cl. ..... 323/250; 323/254; 363/75; 336/212; 336/215

[58] Field of Search ..... 323/48, 56, 89 R, 89 C, 323/249, 250, 254, 362; 363/20, 21, 75, 82, 90; 336/155, 170, 184, 211–215

[56] References Cited

U.S. PATENT DOCUMENTS 1,376,978 5/1921 Stoekle ..... 323/56

3,403,323 9/1968 Wanlass ..... 323/56

3,582,829 6/1971 Wanlass ..... 323/56

3,686,561 8/1972 Spreadbury ..... 336/215

*Primary Examiner*—William M. Shoop

*Assistant Examiner*—Peter S. Wong

*Attorney, Agent, or Firm*—Hill, Van Santen, Steadman, Chiara & Simpson

[57] ABSTRACT

A transformer for voltage regulators has a first core provided with four legs and two common base plates, which are magnetically joined to the four legs, with an input winding being wound on the first and second legs, an output winding being wound on the legs in a transformer-coupling manner to the input winding, and a control winding being wound on the first and third legs in an orthogonal coupling manner with the first winding, and a second core joined to one of the common base plates of the first core to form a magnetical loop with a coil being wound thereon.

4 Claims, 14 Drawing Figures

TRANSFORMER FOR VOLTAGE REGULATORS

BACKGROUND OF THE INVENTION

1. Field of the Invention

This invention relates to a transformer for voltage regulators, and more particularly to a novel transformer suitable for use in a constant voltage circuit which is formed by combination of a saturable transformer and a switching regulator.

2. Description of the Prior Art

This application is an improvement of my copending application, Ser. No. 138,341 filed Apr. 8, 1980 for "Voltage Regulator Using Saturable Transformer".

Now, a consideration will be taken into a transformer as shown in FIG. 1, in which 10 designates the transformer as a whole. Transformer 10 includes a pair of magnetic cores 11 and 12 made of ferrite, each having a base portion 10E in a shape of, for example, square plate and legs 10A, 10B, 10C and 10D respectively erected vertically from four corners of base 10E. Respective legs 10A to 10D have the same sectional area. Core 11 is arranged in opposition to core 12 in such a manner that each leg of the former may contact at its end with that of the latter. Accordingly, cores 11 and 12 are assembled in a shape of a cube or rectangular parallelepiped as a whole.

A primary winding (exciting winding) $N_1$ is wound spreading over legs 10B and 10D of core 11 and a secondary winding $N_2$ is wound spreading over legs 10A and 10C of core 11, while a control winding $N_c$ is wound spreading over legs 10A and 10B of core 12. Therefore, windings $N_1$ and $N_2$ are in a transformer-coupling mode with coupling factor of about 0.5 to 0.6, while windings $N_1$, $N_2$ and winding $N_c$ are in an orthogonal-coupling mode. Control winding $N_c$ is connected in parallel with a control voltage source $E_c$.

Transformer 10 as mentioned above will have a magnetic flux distribution mode shown in FIGS. 2A and 2B, by way of example. That is, let it be assumed that an exciting current of winding $N_1$ and its number of turns are $I_1$ and $N_1$, a current of winding $N_2$ and its number of turns are $I_2$ and $N_2$, a load current obtained from winding $N_2$ is $I_L$, and a total exciting current is I, respectively. Then, a total magnetomotive force NI of transformer 10 is expressed as follows:

$$NI = N_1I_1 + N_2I_2 + N_2I_L$$

Let it further be assumed that this magnetomotive force NI is caused to produce magnetic flux $+\phi_s$ during the period of positive half cycle of output voltage $E_o$ (refer to FIG. 2A) while magnetic flux $-\phi_s$ during the period of negative half cycle thereof (refer to FIG. 2B), and control winding $N_c$ and control current $I_c$ flowing therethrough are caused to produce magnetic flux $\phi_c$, respectively. In this case, magnetic fluxes $\phi_s$ and $\phi_c$ are decreased from each other at legs 10A and 10D but added to each other at legs 10B and 10C during the period of positive half cycle (FIG. 2A), and reverse relation therebetween is obtained during the period of negative half cycle (FIG. 2B).

Accordingly, in the B–H characteristic curve (magnetization curve) of FIG. 3, at the peak time point during the period of positive half cycle the operating point of legs 10A, 10D is expressed by ① and that of legs 10B, 10C is expressed by ②, while at the peak time point during the period of negative half cycle the operating point of legs 10B, 10C is expressed by ③ and that of legs 10A, 10D is expressed by ④, respectively. Accordingly, the operating region of legs 10A, 10D corresponds to a section indicated by arrow 1A and the operating region of legs 10B, 10C corresponds to a section indicated by arrow 1B. Output voltage $E_o$ during the period of positive half cycle is determined by magnetic flux density $+B_s$ of legs 10, 10D at point ①, and output voltage $E_o$ during the period of negative half cycle is determined by magnetic flux density $-B_s$ of legs 10B, 10C at point ③.

The positions of points ① and ③ are changed by magnetic flux $\phi_c$, which is in turn changed according to control current $I_c$, so that if current $I_c$ is controlled, output voltage $E_o$ can also be controlled.

FIG. 4 shows an equivalent circuit of transformer 10. In this circuit, output voltage $E_o(t)$ is expressed as follows:

$$\begin{aligned} E_o(t) &= \frac{d}{dt}\Phi(t) = \frac{d}{dt}[L_2 \cdot i(t)] \\ &= L_2\frac{di(t)}{dt} + i(t)\frac{dL}{dt} \\ &= N_2\frac{d\Phi(t)}{dt} + i(t)\frac{dL}{dt} \end{aligned}$$

where $L_2 \cdot i(t) = N_2 \cdot \Phi$ and $L_2$ is inductance of $N_2$. In the above equation, the first term represents a voltage induced by transformer coupling, and the second term represents a voltage induced by parametric coupling. In other words, output voltage $E_o(t)$ contains the voltage caused by transformer coupling and the voltage caused by parametric coupling. The ratio between both voltages depends upon the coupling factor of windings $N_1$ and $N_2$, or the shape of core and winding method of windings.

Referring to a graph of FIG. 5, if magnetic flux at $I_c=0$ is taken as $\Phi_1$, magnetic flux when $\phi_s$ and $\phi_c$ are added to each other is as $\Phi_2$, magnetic flux when decreased from each other is as $\Phi_3$, and the variations of $\Phi_2$ and $\Phi_3$ from $\Phi_1$ are as $\Delta\Phi_2$, $\Delta\Phi_3$, respectively, an output voltage $e_o$ at $I_c=0$ is given by the following equation:

$$\begin{aligned} e_o &= N_2\frac{d(\Phi_1 + \Phi_1)}{dt} + \frac{N_2}{L_2}(\Phi_1 + \Phi_1)\frac{dL}{dt} \\ &= 2\phi_1\left(KN_2f + \frac{N_2}{L_2}\ \frac{dL}{dt}\right) \end{aligned}$$

Further, when magnetic flux $\Phi_3$ is in non-linear region at $I_c \neq 0$, an output voltage $e_{os}$ is given as follows:

$$\begin{aligned} e_{os} &= N_2\frac{d(\Phi_2 + \Phi_3)}{dt} + \frac{N_2}{L_2}(\Phi_2 + \Phi_3)\frac{dL}{dt} \\ &= [2\Phi_1 - (\Delta\Phi_3 - \Delta\Phi_2)]\left(KN_2f + \frac{N_2}{L_2}\ \frac{dL}{dt}\right) \end{aligned}$$

Because of non-linearity of B-H curve, $\Delta\Phi_3 >> \Delta\Phi_2$ is obtained. Therefore, the following relation is given:

$$e_o - e_{os} = (\Delta\Phi_3 - \Delta\Phi_2)\left(KN_2f + \frac{N_2}{L_2}\ \frac{dL}{dt}\right)$$

If a point 5 corresponding to $\Phi_1$ and point 2 corresponding to $\Phi_2$ are assumed to be in saturated region, $\Delta\Phi_2 \cong 0$ is obtained, so that the following equation can be given:

$$e_o - e_{os} = \Delta\Phi_3 \left( KN_2 f + \frac{N_2}{L_2} \frac{dL}{dt} \right)$$

According to the above equation, if flux variation $\Delta\Phi_3$ is controlled by control current $I_c$, maximum flux density $B_s$ of transformer 10 is controlled with the result that output voltage $E_o$ can be controlled. If the influence of temperature variation of maximum flux density $B_s$, variation of input voltage, load variation or the like is compensated for by control current $I_c$, output voltage $E_o$ can be stabilized.

In general, however, the iron loss of a transformer is proportional to the volume of a magnetic core, exciting frequency, and magnetic flux density, while the copper loss thereof is proportional to the number of turns of windings and the volume of core, and the total loss $W_t$ is given as follows:

$$W_t = W_f + W_c$$

where $W_f$ is iron loss and $W_c$ is copper loss.

Then, if the temperature rise of the transformer is taken as $\Delta T$ and the output thereof as $P_o$, they are expressed as follows:

$$\Delta T = \alpha Wt/A$$

$$P_o = \beta S N_a f B_s F_s J$$

where $\alpha$: constant based upon heat transfer coefficient,
A: total radiating area of transformer,
$\beta$: constant based upon form factor,
S: effective sectional area of core,
$N_a$: effective sectional area of winding,
f: exciting frequency,
$B_s$: maximum magnetic flux density,
$F_s$: space factor of winding, and
J: current density of winding Accordingly, when output $P_o$ of transformer 10 is constant, as maximum flux density $B_s$ is increased, $(SN_a)$ becomes small and hence transformer 10 can be made compact. However, if transformer 10 is made compact, sectional area S becomes small so that temperature rise $\Delta T$ is increased due to loss $W_t$. Such an increase of temperature rise $\Delta T$ results in undesirable reliability reduction. Accordingly, a prior art has a drawback that a power supply system becomes large and heavy for the purpose of radiation.

SUMMARY OF THE INVENTION

Accordingly, an object of this invention is to provide a transformer for voltage regulators which is free from the above mentioned drawbacks.

Another object of this invention is to provide a transformer for voltage regulators which is small in size and weight with low cost.

A further object of this invention is to provide a transformer for voltage regulators which is low in temperature rise.

According to the main feature of this invention, a transformer for voltage regulators comprises a first core having four legs and two common base plates magnetically joined to the four legs, an input winding wound on the first and second legs, an output winding wound on the legs in a transformer-coupling manner to the input winding, and a control winding wound on the first and third legs in an orthogonal coupling manner with the first winding. The transformer further comprises a second core joined to one of the common base plates of the first core to form a magnetical loop, and a coil wound on the magnetic loop of the second core.

Various further and more specific objects, features and advantages of this invention will appear from the description given below, taken in connection with accompanying drawings.

DESCRIPTION OF THE PREFERRED EMBODIMENTS

A description will hereinafter be given on one example of a transformer of this invention with reference to FIG. 6.

Figure 6:
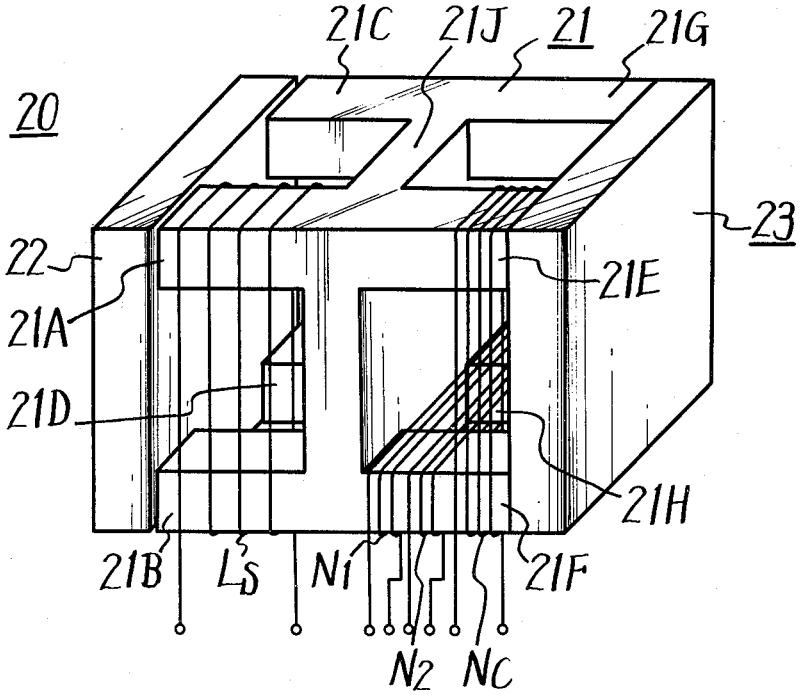
FIG. 6 is a perspective view showing one example of a transformer of this invention.

In FIG. 6, 20 generally designates a transformer which has magnetic cores 21, 22 and 23. Core 21 is composed of a core base 21J in a shape of, for example, square plate, magnetic legs 21A, 21B, 21C, 21D respectively erected perpendicularly from four corners on one surface of base 21J, and magnetic legs 21E, 21F, 21G, 21H respectively erected perpendicularly from four corners on the other surface of base 21J. These legs 21A to 21H are all same in sectional area. Cores 22 and 23 are made identical in shape with base 21J of core 21. Core 22 is arranged opposite to the end surfaces of legs 21A, 21B, 21C and 21D, each having a predetermined gap with the surface of core 22, while core 23 is arranged in contact with the end surfaces of legs 21E, 21F, 21G and 21H. Thus, core 21, 22 and 23 are assembled to form a cube or rectangular parallelepiped as a whole. Cores 21 to 23 are made of ferrite, by way of example.

With such a core structure as mentioned above, a coil $L_s$ serving as a stabilizing choke coil, which will be described later, is wound extending over legs 21A and 21B, while an input or primary winding $N_1$ and an output or secondary winding $N_2$ are wound extending over legs 21F and 21H and also a control winding $N_c$ is wound extending over legs 21E and 21F.

Figure 7:
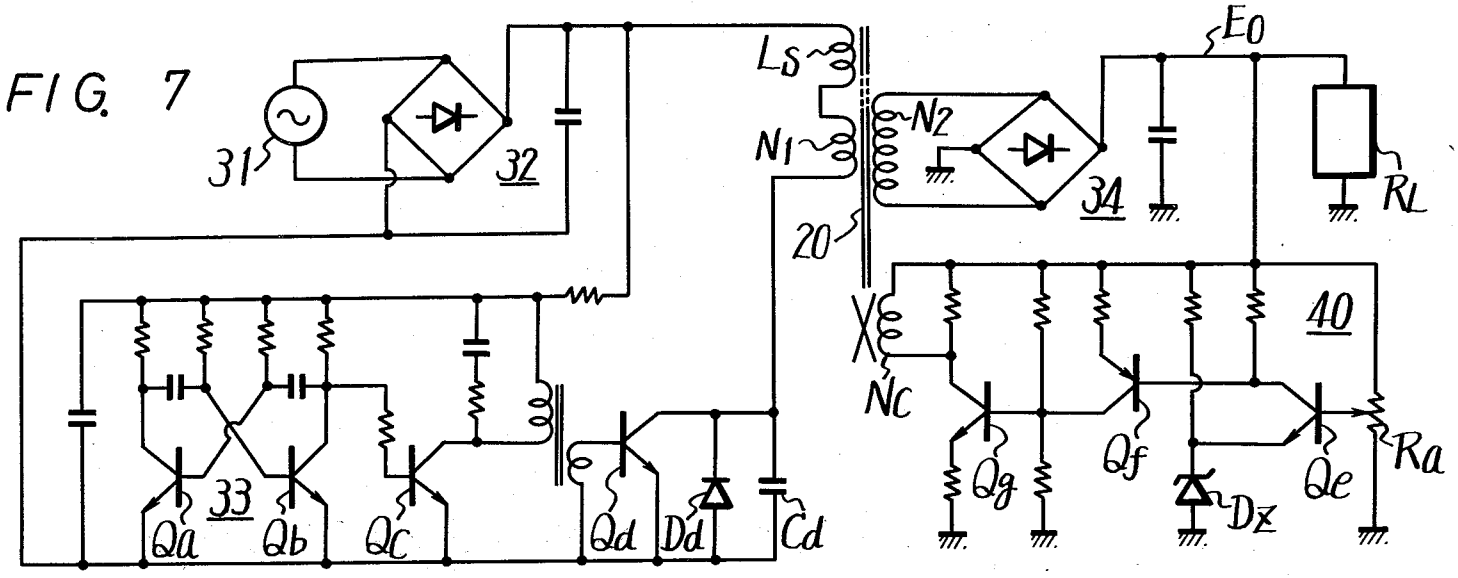
FIG. 7 is a connection diagram showing one example of a voltage regulator using the transformer of FIG. 6.

One example of the circuit of a voltage regulator using above transformer 20 is shown in FIG. 7. In this example, however, an output voltage $E_o$ is provided only by transformer coupling.

In FIG. 7, 31 designates a commercial AC power source of, for example, 100 V and 32 a rectifier circuit for rectifying an AC voltage therefrom. The output end of rectifier circuit 32 is connected to a series circuit of coil $L_s$ and winding $N_1$ of transformer 20 and the collector-emitter path of a switching transistor $Q_d$, while a parallel circuit of a switching diode $D_d$ and a resonance capacitor $C_d$ is connected across the collector-emitter path of transistor $Q_d$.

Transistor $Q_a$ and $Q_b$ are combined to form an astable multivibrator 33 to produce a pulse having a frequency in an order of, for example, 15 KHz to 20 KHz, and this pulse is supplied through a driving transistor $Q_c$ to the base of transistor $Q_d$.

Winding $N_2$ of transformer 20 is connected to a rectifier circuit 34 which is in turn connected at its output end to a load $R_L$.

Reference numeral 40 designates a control circuit in which the level of output voltage $E_o$ is detected to produce a control current $I_c$. Output voltage $E_o$ of rectifier circuit 34 is supplied to control circuit 40 as its operating voltage and also supplied to a variable resistor $R_a$. A reference voltage derived from a constant voltage diode $D_z$ is fed to the emitter of a transistor $Q_e$ while a divided output derived from variable resistor $R_a$ is fed to the base thereof to be compared with the reference voltage from diode $D_z$. Thus compared output is supplied from the collector of transistor $Q_e$ through a transistor $Q_f$ to the base of a transistor $Q_g$. The collector of transistor $Q_g$ is connected to control winding $N_c$ of transformer 20.

Figure 8:
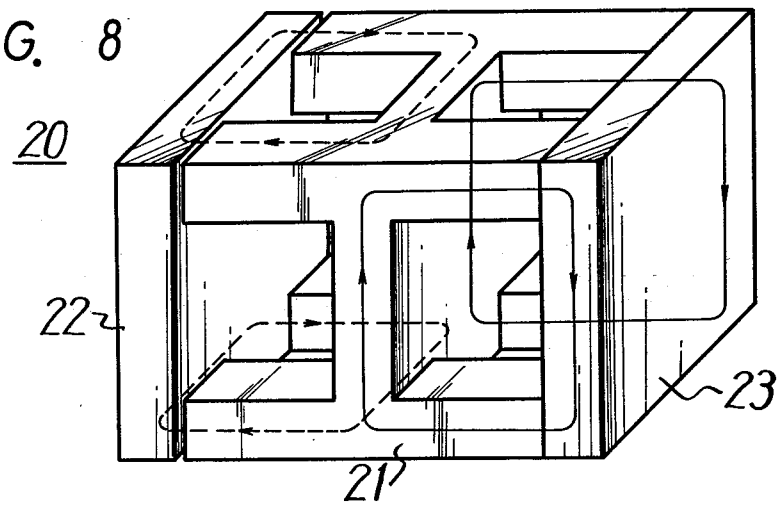
FIG. 8 is a perspective view showing magnetic paths of the transformer of FIG. 6.

With the circuit arrangement as described above, an output pulse of multivibrator 33 is fed to transistor $Q_d$ for switching the same, so that an operation similar to the horizontal deflection circuit of a television receiver is carried out and an exciting current flows through winding $N_1$ of transformer 20. In this case, coil $L_s$ serves to limit a collector current of transistor $Q_d$ at its ON period to stabilize its switching operation. In this case, however, as shown in FIG. 8 the magnetic fluxes generated by coil $L_s$ indicated by broken lines meet at right angles with the magnetic fluxes generated by windings $N_1$, $N_2$ indicated by solid lines so that no interference exists between coil $L_s$ and windings $N_1$, $N_2$. Thus, winding $N_2$ produces an output which is supplied to rectifier circuit 34 and hence load $R_L$ is applied with a DC voltage $E_o$ of, for example, 115 V.

In this case, the variation of output voltage $E_o$ is detected by transistor $Q_e$ and an detected output thereof is supplied to winding $N_c$ of transformer 20 so that control current $I_c$ flows therethrough. In other words, when output voltage $E_o$ is increased, the collector current of transistor $Q_e$ is increased so that the collector current of transistor $Q_f$ is increased. Accordingly, control current $I_c$ flowing through winding $N_c$ is increased to make the maximum magnetic flux density $B_s$ small and hence output voltage $E_o$ becomes low. On the contrary, when output voltage $E_o$ becomes low, control current $I_c$ is decreased to increase magnetic flux density $B_s$ so that output voltage $E_o$ becomes high. As a result, output voltage $E_o$ is closed-loop-controlled and kept constant.

Figure 13:
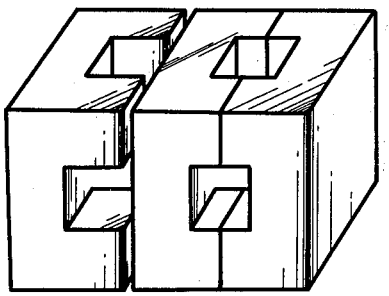
FIG. 13 is a perspective view showing another example of cores used in the transformer of this invention.

Thus, the constant voltage regulator can be constructed by using transformer 20 of this invention. In this case, transformer 20 is integrally provided with coil $L_s$, so that the whole apparatus can be made smaller in size and weight and also the total exterior surface area thereof is increased to improve its radiation efficiency as compared with an example wherein coil $L_s$ is separately provided. Accordingly, the whole construction can be made compact and its radiation can be effectively performed. According to experimetal results, with a transformer using the magnetic cores of FIG. 1, when $E_o$ is selected as 115 V and power consumption $P_L$ of load $R_L$ is set as 70 W, the temperature rise was 70° C. even with a radiator plate being used. With transformer 20 of this invention using magnetic cores shown in FIG. 13, which will be described later, its temperature rise is 37° C. which is far below than the prior art. Further, the transformer using the magnetic core of FIG. 1 has an input electric power of 90 W, while transformer 20 of this invention has an decreased input power of 89 W because of no eddy current loss caused by the radiator plate.

Legs 21A to 21D of transformer 20 and core plate 22 function to radiate heat, but even though temperatures of these portions are increased, the permeability thereof is not changed. Therefore, the inductance of coil $L_s$ is kept constant to prove that legs 21A to 21D and core 22 are being used effectively. Further, even if load $R_L$ is short-circuited by way of example, coil $L_s$ serves as a load of transistor $Q_d$ and hence transistor $Q_d$ is automatically protected from overload. In other words, coil $L_s$ functions for stabilizing and also for protecting.

In addition, according to the miniaturization of transformer 20, windings become short and the number of components is decreased. Further, the radiator plate becomes disused, so that the aforesaid miniaturization is also effective to cost reduction.

Figure 9:
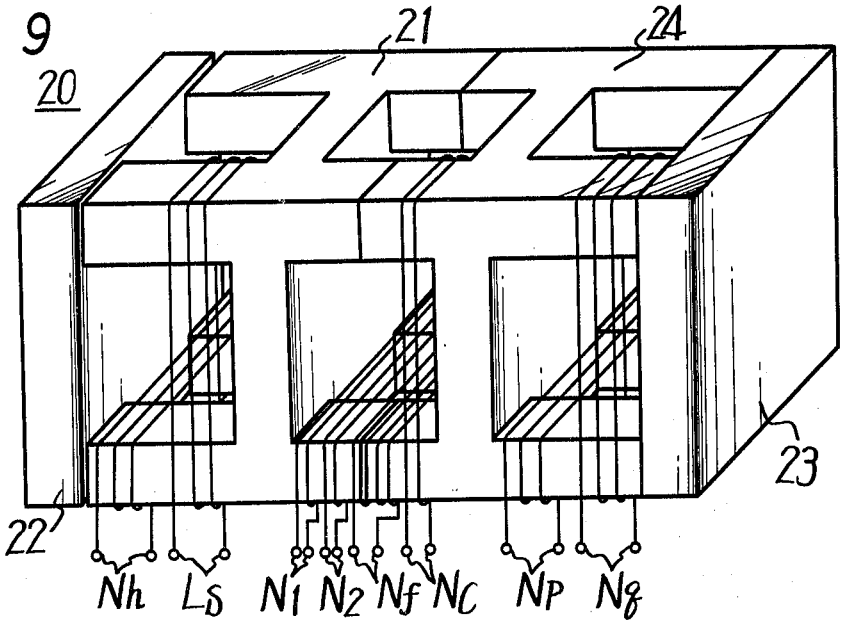
FIG. 9 is a perspective view showing another example of the transforner of this invention.

FIG. 9 shows another example of this invention, in which elements corresponding to those of FIG. 6 are indicated by the same reference numerals and characters. In this example, a flyback transformer, horizontal output transformer, right and left pincushion distortion correcting transformer of a television receiver are integrally formed. In other words, a core 24 same as core 21 is disposed between cores 21 and 23. Core 21 is wound with an input winding of horizontal output transformer, $N_h$, and stabilizing coil $L_s$ in an orthogonal coupling manner, and cores 21 and 24 are wound with windings $N_1$, $N_2$ and a high-tension winding of flyback transformer, $N_f$. Control winding $N_c$ is also wound on core 24 in an orthogonal coupling mode with windings $N_1$, and $N_2$ and $N_f$. In addition, core 24 is wound with an input winding of pincushion distortion correcting transformer, $N_q$, and an output winding of the same, $N_p$, in an orthogonal coupling manner with each other.

Figure 10:
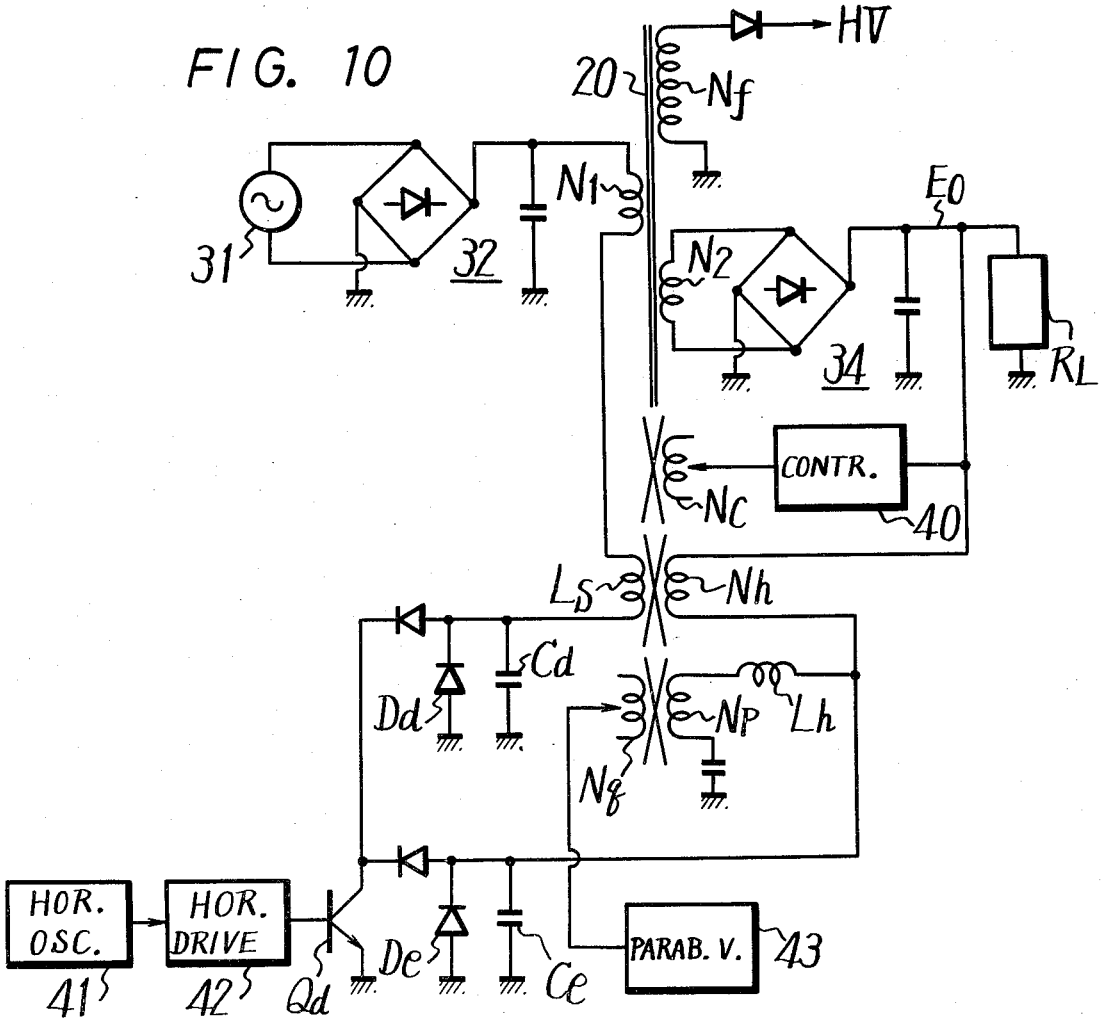
FIG. 10 is a connection diagram showing another example of a voltage regulator using the transformer of FIG. 9.

FIG. 10 shows a circuit connection of a voltage regulator using the above transformer 20, in which 41 designates a horizontal oscillator circuit, 42 a horizontal drive circuit, De a damper diode, Ce a resonance capacitor, Lh a horizontal deflecting coil, and 43 a vertical-period parabolic voltage forming circuit, respectively.

Figure 3:
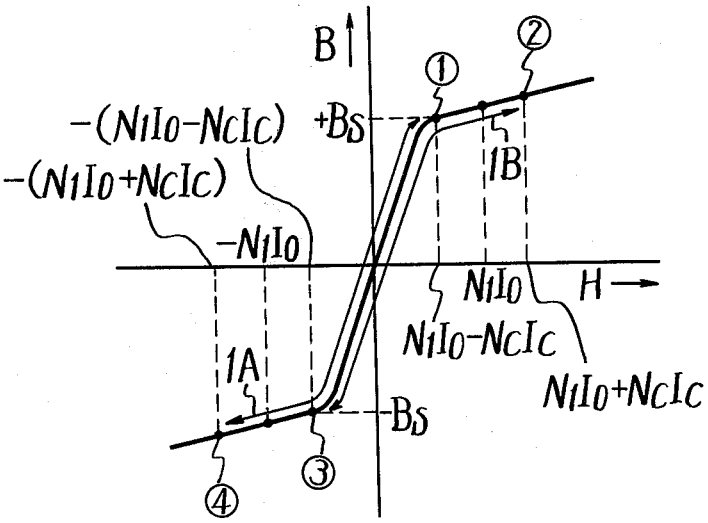
FIGS. 3, 4 and 5 are views respectively used for explaining the transformer of FIG. 1.
Figure 4:
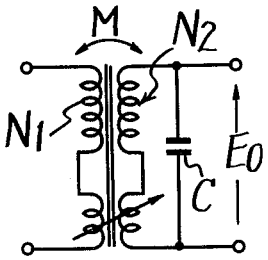
Figure 2A:
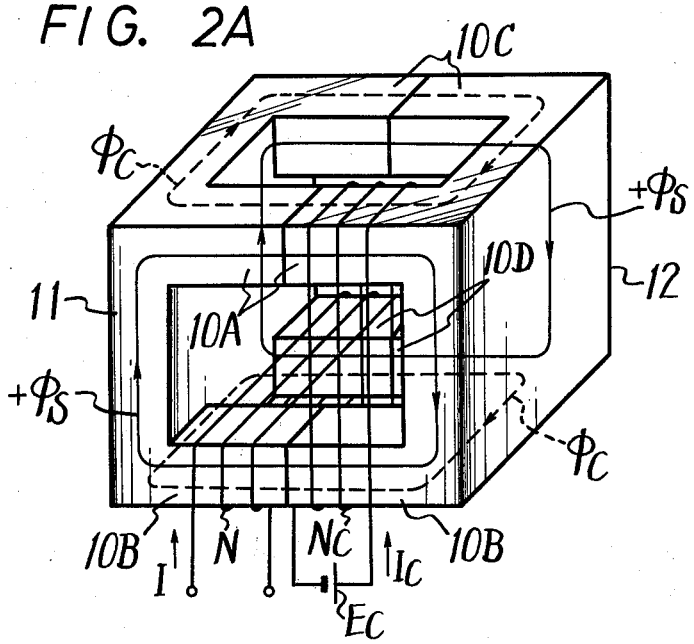
FIGS. 2A and 2B are perspective views showing magnetical paths of the transformer shown in FIG. 1.
Figure 2B:
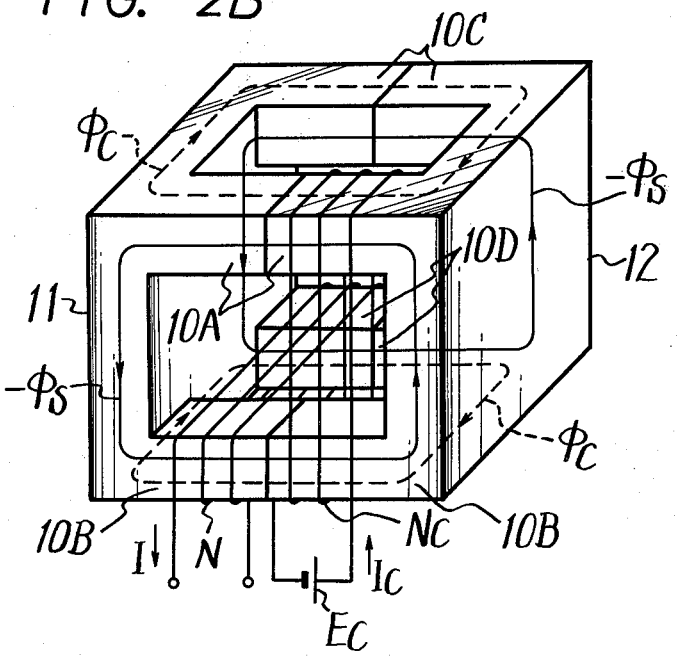
Figure 5:
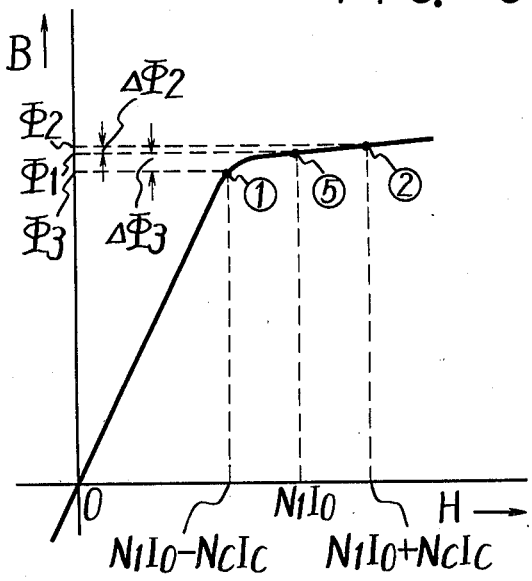

In the above-described examples, the operation of transformer 20 can be explained with reference to FIG. 3. In this case, however, operating points can also be changed as follows.

Figure 11:
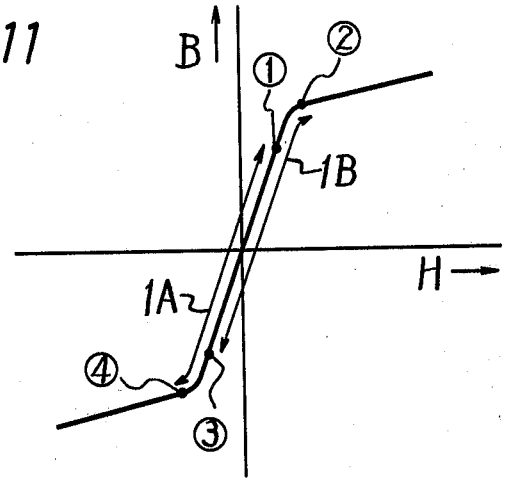
FIGS. 11 and 12 are graphs used for explaining a further example of this invention.
Figure 12:
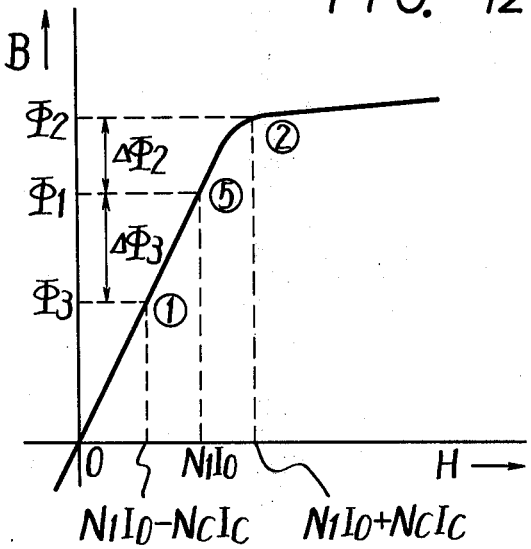

As shown in FIGS. 11 and 12, if operating points ① and ③ with magnetic fluxes $\phi_s$ and $\phi_c$ being decreased from each other are in the linear region and operating points ② and ④ with the same being added to each other are in the non-linear region, the parametric coupling can be neglected, so that output voltage $e_o$ at $I_c=0$ is expressed as follows:

$$e_o = N_2 \frac{d}{dt} (\Phi_1 + \Phi_1)$$

While, output voltage $e_{os}$ with $I_c \neq 0$ and $\Phi_2$ being in the non-linear region is expressed as follows:

$$e_{os} = N_2 \frac{d}{dt} (\Phi_2 + \Phi_3)$$
$$= N_2 \frac{d}{dt} [2\Phi_1 - (\Delta\Phi_3 - \Delta\Phi_2)]$$

Therefore, $$e_o - e_{os} = N_2 \frac{d}{dt} (\Delta\Phi_3 - \Delta\Phi_2)$$
$$= KN_2 f(\Delta\Phi_3 - \Delta\Phi_2)$$

If $\Delta\Phi_3 > \Delta\Phi_2$ is assumed, the following relation can be obtained $$e_o - e_{os} = KN_2 f \Delta\Phi_3$$

Thus, $\Delta\Phi_3$ is changed according to control current $I_c$ to change output voltage $E_o$ and hence a constant voltage output can be obtained.

Besides, in this case, since magnetic flux density $B_s$ becomes small, exciting current $I_1$ can be reduced, and accordingly the iron loss of cores 11 and 12 and the copper loss of winding $N_1$ can be decreased so that heat generation is reduced even in the prior art low-cost ferrite core.

With the aforesaid transformer 20, the parametric oscillaton can be performed with a resonance capacitor C being connected across winding $N_2$. In this case, if a capacitor is connected in parallel to coil $L_s$ for resonance with the exciting frequency, the component of collector voltage of transistor $Q_d$ will not affect output voltage $E_o$.

Figure 1:
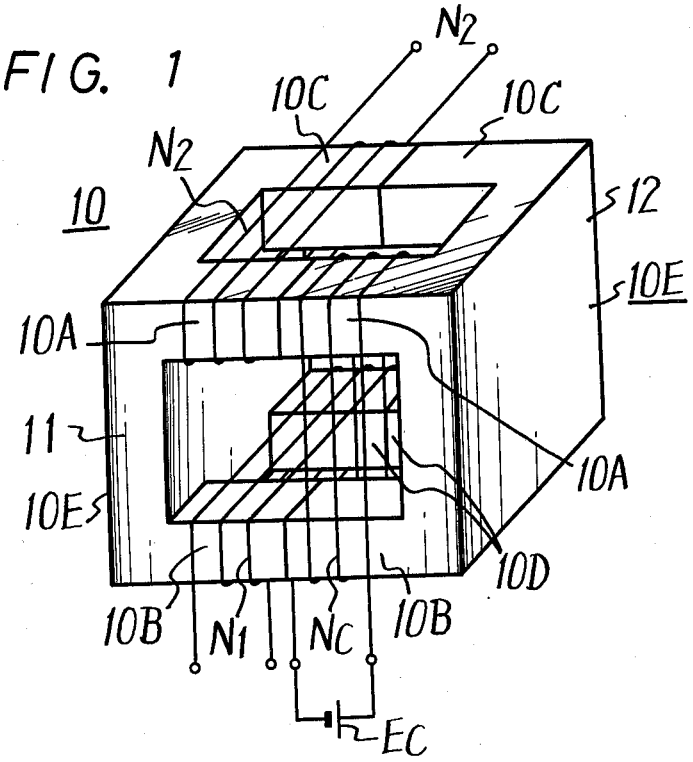
FIG. 1 is a perspective view showing one example of a transformer used for explaining a prior art.

In the case of performing the parametric oscillation, winding $N_2$ can also be wound spreading over legs 21E and 21G of transformer 20 of FIG. 6 in the same manner as transformer 10 of FIG. 1.

While the principles of this invention have been described above in connection with a specific embodiment and particular modifications thereof, it is to be clearly understood that this description is made only by way of example and not as a limitation on the scope of this invention.

I claim as my invention:

1. A transformer for voltage regulators comprising:

a first core means having first, second, third and fourth legs and two common portions which are magnetically joined to said four legs;

a primary winding wound on said first and second legs;

a secondary winding wound on the legs in such a manner that alternating magnetic flux is transferred from said primary winding to said secondary winding;

a control winding wound on said first and third legs in such a manner that no alternating flux is transferred from said primary winding to said control winding;

a second core means joined to one common portion of said first core means to form a magnetic loop therein; and a coil means wound on said magnetic loop of the second core means.

2. A transformer according to claim 1, wherein said second core means has four legs and a side plate which is magnetically joined to said four legs of the second core means, said four legs of the second core means being joined to the one common portion of said first core means.

3. A transformer according to claim 1, wherein said primary winding is supplied with an alternating current from a switching converter having a switching device and an oscillator, and said control winding is supplied with a DC control current from a control circuit so as to make the amplitude of an output voltage from said secondary winding constant.

4. A transformer according to claim 3, wherein said coil means on the second core is electrically connected between said primary winding and a fluctuated DC voltage source.

* * * * *